US009404350B2

(12) United States Patent
Allen

(10) Patent No.: US 9,404,350 B2
(45) Date of Patent: Aug. 2, 2016

(54) FLOW-ACTIVATED FLOW CONTROL DEVICE AND METHOD OF USING SAME IN WELLBORES

(71) Applicant: Jason A. Allen, Houston, TX (US)

(72) Inventor: Jason A. Allen, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 287 days.

(21) Appl. No.: 14/028,060

(22) Filed: Sep. 16, 2013

(65) Prior Publication Data

US 2015/0075800 A1 Mar. 19, 2015

(51) Int. Cl.

| | |
|---|---|
| ***E21B 34/08*** | (2006.01) |
| ***E21B 43/12*** | (2006.01) |
| ***E21B 34/14*** | (2006.01) |
| ***E21B 21/10*** | (2006.01) |
| *E21B 34/00* | (2006.01) |

(52) U.S. Cl.

CPC ..... *E21B 43/12* (2013.01); *E21B 21/10* (2013.01); *E21B 34/08* (2013.01); *E21B 34/14* (2013.01); *E21B 2034/007* (2013.01)

(58) Field of Classification Search

USPC ..... 166/320

See application file for complete search history.

(56) References Cited

U.S. PATENT DOCUMENTS

| | | | | |
|---|---|---|---|---|
| 2,257,344 | A | 9/1941 | Maloney | |
| 2,565,742 | A | 8/1951 | Sailers | |
| 2,629,444 | A | 2/1953 | O'Donnell | |
| 3,302,722 | A | 2/1967 | Madely, Sr. | |
| 3,831,632 | A * | 8/1974 | Young | E21B 34/08 137/39 |
| 4,128,105 | A * | 12/1978 | Follett | F16K 17/34 137/1 |
| 4,428,428 | A | 1/1984 | Smyrl et al. | |
| 4,700,776 | A | 10/1987 | Petrovic | |
| 5,839,523 | A | 11/1998 | North | |
| 6,382,319 | B1 | 5/2002 | Hill, Jr. et al. | |
| 6,446,729 | B1 | 9/2002 | Bixenman et al. | |
| 6,464,006 | B2 | 10/2002 | Womble | |
| 6,568,472 | B1 | 5/2003 | Gano et al. | |
| 6,789,623 | B2 | 9/2004 | Hill, Jr. et al. | |
| 7,331,388 | B2 | 2/2008 | Vilela et al. | |
| 7,543,647 | B2 | 6/2009 | Walker | |
| 7,950,454 | B2 | 5/2011 | Patel et al. | |
| 8,770,292 | B2 | 7/2014 | McClung, III | |
| 2004/0140089 | A1 | 7/2004 | Gunneroed | |

(Continued)

FOREIGN PATENT DOCUMENTS

| | | | |
|---|---|---|---|
| GB | 2382828 | A | 6/2003 |
| WO | 2011028560 | A2 | 3/2011 |
| WO | 2011028563 | A3 | 3/2011 |

OTHER PUBLICATIONS

PCT International Search Report and Written Opinion; International Application No. PCT/US2014/050334; International Filing Date: Aug. 8, 2014; Date of Mailing: Nov. 27, 2014; pp. 1-11.

(Continued)

*Primary Examiner* — Taras P Bemko

(74) *Attorney, Agent, or Firm* — Cantor Colburn LLP

(57) ABSTRACT

A flow control device for use in a wellbore is disclosed that in one non-limiting embodiment may include a main flow passage and a weep hole, wherein the main flow passage closes when a fluid is supplied to a first end of the valve that exceeds a selected rate and opens when the fluid supplied is below the selected rate and wherein the weep hole continues to allow the fluid therethrough.

16 Claims, 3 Drawing Sheets

(56) References Cited

U.S. PATENT DOCUMENTS

| | | | | |
|---|---|---|---|---|
| 2005/0082060 | A1 | 4/2005 | Ward et al. | |
| 2005/0156131 | A1* | 7/2005 | Holliday | F16K 3/0254 251/326 |
| 2007/0068675 | A1 | 3/2007 | Barry et al. | |
| 2008/0099194 | A1 | 5/2008 | Clem | |
| 2008/0314591 | A1 | 12/2008 | Hales et al. | |
| 2009/0294177 | A1 | 12/2009 | Chan et al. | |
| 2010/0200245 | A1 | 8/2010 | Ringgenberg et al. | |
| 2011/0056686 | A1 | 3/2011 | Clem | |
| 2011/0067886 | A1 | 3/2011 | Moen | |
| 2011/0209919 | A1 | 9/2011 | Aros | |
| 2012/0085548 | A1 | 4/2012 | Fleckenstein et al. | |
| 2012/0097397 | A1 | 4/2012 | Hofman et al. | |
| 2012/0103608 | A1 | 5/2012 | Van Petegem et al. | |
| 2012/0118579 | A1 | 5/2012 | Murray et al. | |
| 2014/0246206 | A1 | 9/2014 | Least et al. | |

OTHER PUBLICATIONS

PCT International Search Report and Written Opinion; International Application No. PCT/US2015/057995; International Filing Date: Oct. 29, 2015; Date of Mailing: Jan. 25, 2016; pp. 1-14.

* cited by examiner

FLOW-ACTIVATED FLOW CONTROL DEVICE AND METHOD OF USING SAME IN WELLBORES

BACKGROUND

1. Field of the Disclosure

This disclosure relates generally to apparatus and methods for completing a wellbore for the production of hydrocarbons from subsurface formations, including fracturing selected formation zones in a wellbore, sand packing and flooding a formation with a fluid.

2. Background of the Art

Wellbores are drilled in subsurface formations for the production of hydrocarbons (oil and gas). Modern wells can extend to great well depths, often more than 1500 meters (about 15,000 ft.). Hydrocarbons are trapped in various traps in the subsurface formations at different depths. Such sections of the formation are referred to as reservoirs or hydrocarbon-bearing formations or zones. Some formations have high mobility, which is a measure of the ease of the hydrocarbons flow from the reservoir into a well drilled through the reservoir under natural downhole pressures. Some formations have low mobility and the hydrocarbons trapped therein are unable to move with ease from the reservoir into the well. Stimulation methods are typically employed to improve the mobility of the hydrocarbons through the reservoirs. One such method, referred to as fracturing (also referred to as "fracing" or "fracking"), is often utilized to create cracks in the reservoir to enable the fluid from the formation (formation fluid) to flow from the reservoir into the wellbore. To fracture multiple zones, an assembly containing an outer string with an inner string therein is run in or deployed in the wellbore. The outer string is conveyed in the wellbore with a tubing attached to its upper end and it includes various devices corresponding to each zone to be fractured for supplying a fluid with proppant to each such zone. The inner string includes devices attached to a tubing to operate certain devices in the outer string and facilitate fracturing and/or other well treatment operations. For selectively treating a zone in a multi-zone wellbore, it is desirable to have an inner sting that can be selectively set corresponding to any zone in a multi-zone well and perform a well operation at such selected zone. Once a zone has been treated, the wellbore is filled with the treatment fluid, which may include a base fluid, such as water, proppant, such as sand or synthetic sand-like particles and an additive, such as guar. A valve, such as check valve, is often used to provide a fluid flow path from an annulus between an outer string and an inner string used for the treatment operation to the inner string so that a fresh fluid may be supplied to the annulus to remove the treatment fluid from the wellbore. This process is generally referred to a reverse circulation.

The disclosure herein provides apparatus and methods for enabling reverse circulation of fluid.

SUMMARY

In one aspect, an apparatus for use in a wellbore is disclosed that in one non-limiting embodiment includes A flow control device for use in a wellbore is disclosed that in one non-limiting embodiment may include a main flow passage and a weep hole, wherein the main flow passage closes when a fluid is supplied to a first end of the valve that exceeds a selected rate and opens when the fluid supplied is below the selected rate and wherein the weep hole continues to allow the fluid therethrough.

Examples of the more important features of a well treatment system and methods that have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
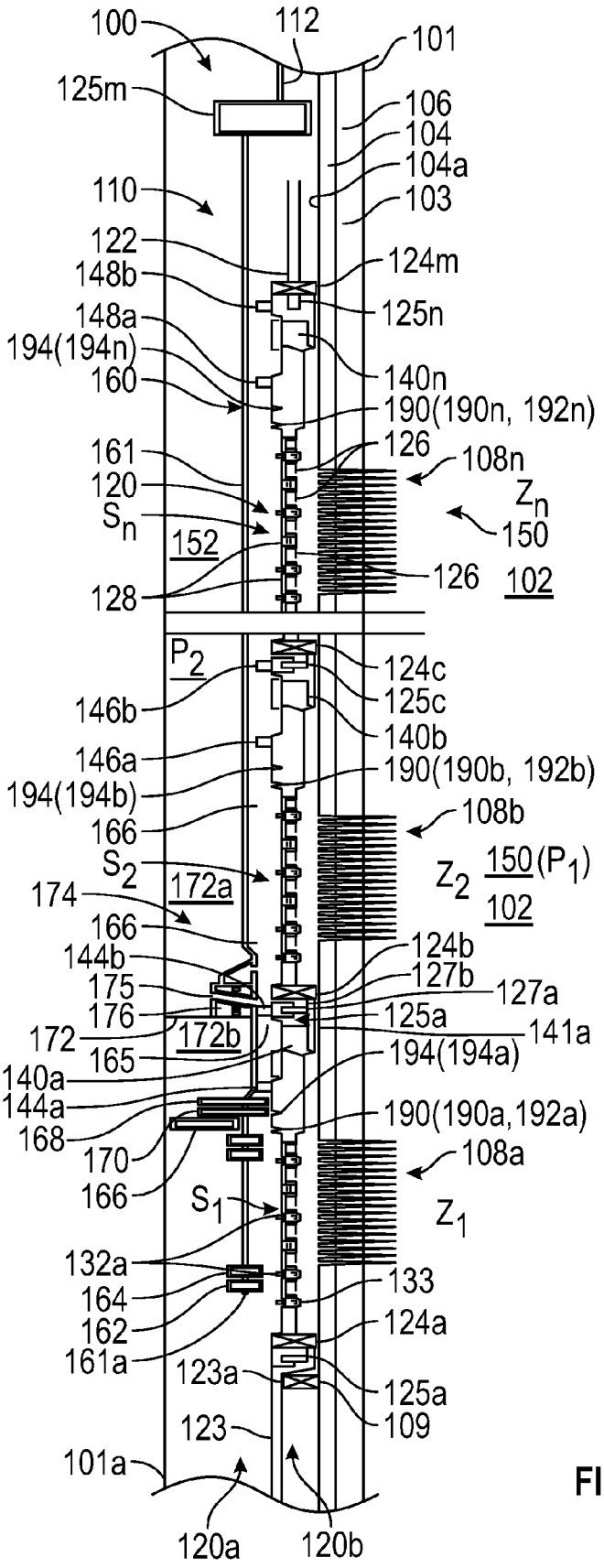
FIG. 1 shows an exemplary cased hole multi-zone wellbore that has a service assembly deployed therein that includes an outer string and an inner string for performing a treatment operation, according to one non-limiting embodiment of the present.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, such as a string of jointed metal pipes sections, known in the art. The space or annulus 103 between the casing 104 and the wellbore 101 is filled with cement 106. The particular embodiment of FIG. 1 is shown for selectively fracking one or more zones in any selected or desired sequence or order. However, well bore 101 may be configured to perform other treatment or service operations, including, but not limited to, gravel packing and flooding a selected zone to move fluid in the zone toward a production well (not shown). The formation 102 is shown to include multiple zones Z1-Zn which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 perforations 108*b*, and Zone Zn perforations 108*n*. The perforations in each zone provide fluid passages for fracturing each such zone. The perforations also provide fluid passages for formation fluid 150 to flow from the formation 102 to the inside 104*a* of the casing 104. The wellbore 101 includes a sump packer 109 proximate to the bottom 101*a* of the wellbore 101. The sump packer 109 is typically deployed after installing casing 104 and cementing the wellbore 101. The sump packer 109 is tested to a pressure rating before treating the well, such as fracturing and packing, which pressure rating may be below the expected pressures in the wellbore 101 after a zone has been treated and isolated.

After casing, cementing, perforating and sump packer deployment, the wellbore 101 is ready for treatment operations, such as fracturing and gravel packing of each of the production zones Z1-Zn. Although system 100 is described in reference to fracturing and sand packing production zones, the apparatus and methods described herein or with obvious modifications may also be utilized for other well treatment operations, including, but not limited to, gravel packing and water flooding. The formation 102 has a fluid 150 therein at formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and prevents blow-outs.

Still referring to FIG. 1, to fracture (treat) one or more zones Z1-Zn, a system assembly 110 is run inside the casing 104 by a conveying member 112, which may be a tubular made of jointed pipe section, known in the art. In one non-limiting embodiment, the system assembly 110 includes an outer string 120 and an inner string 160 placed inside the outer string 120. The outer string 120 includes a pipe 122 and a number of devices associated with each of the zones Z1-Zn for performing treatment operations described in detail below. In one non-limiting embodiment, the outer string 120 includes a sealing member 123*a*, outside and proximate to a bottom end 123 of the outer string 120. The outer string 120 further includes a lower packer 124*a*, an upper packer 124*m* and intermediate packers 124*b*, 124*c*, etc. The lower packer 124*a* isolates the sump packer 109 from hydraulic pressure exerted in the outer string 120 during fracturing and sand packing of the production zones Z1-Zn. In this case the number of packers in the outer string 120 is one more than the number of zones Z1-Zn. In some cases, the lower packer 109, however, may be utilized as the lower packer 124*a*. In one non-limiting embodiment, the intermediate packers 124*b*, 124*c*, etc. may be configured to be independently deployed in any desired order so as to fracture and pack any of the zones Z1-Zn in any desired order. In another embodiment, some or all the packers may be configured to be deployed at the same time or substantially at the same time. In one aspect, packers 124*a*-124*m* may be hydraulically set or deployed packers. In another aspect, packers 124*a*-124*m* may be mechanically set or deployed.

Still referring to FIG. 1, the outer string 120 further includes a screen adjacent to each zone. For example, screen S1 is shown placed adjacent to zone Z1, screen S2 adjacent zone Z2 and screen Sn adjacent to zone Zn. The lower packer 124*a* and intermediate packer 124*b*, when deployed, will isolate zone Z1 from the remaining zones: packers 124*b* and 124*c* will isolate zone Z2 and packers 124*m*-1 and 124*m* will isolate zone Zn. In one non-limiting embodiment, each packer has an associated packer activation device, such as a valve, that allows selective deployment of its corresponding packer in any desired order. In FIG. 1, a packer activation device 125*a* is associated with the lower packer 124*a*, device 125*b* with intermediate packer 124*b*, device 125*c* with intermediate packer 124*c* and device 125*m* with the upper packer 124*m*. In one aspect, packers 124*a*-224*m* may be hydraulically-activated packers. In one aspect, the lower packer 124*a* and the upper packer 124*m* may be activated at the same or substantially the same time when a fluid under pressure is supplied to the pipe 112. In one non-limiting embodiment, the activation devices associated with the intermediate packers 124*b*, 124*c*, etc. may include a balanced piston device that remains under a balanced pressure condition (also referred to herein as the "inactive mode") to prevent a pressure differential between the inside 120*a* and outside 120*b* of the outer sting 120 to activate the packer. When a packer activation device is activated by an external mechanism, it allows pressure of the fluid in the outer string 120 to cause its associated packer to be set or deployed.

Still referring to FIG. 1, in one non-limiting embodiment, each of the screens S1-Sn may be made by serially connecting two or more screen sections with interconnecting connection members to form a screen of a desired length, wherein the interconnections provide axial fluid communication between the adjacent screen sections. For example, screen Sn is shown to include screen sections 126 interconnected by connections 128. The connections 128 may include a flow communication device, such as a sliding sleeve valve or sleeve 132*a*, to provide flow of the fluid 150 from the formation 102 into the outer string 120. Similarly, other screens may also include several screen sections and corresponding connection devices. The connections 128 allow axial flow between the screen sections 126. The outer string 120 also includes, for each zone, a flow control device, referred to as a slurry outlet or a gravel exit, such as a sliding sleeve valve or another valve, uphole or above its corresponding screen to provide fluid communication between the inside 120*a* of the outer string 120 and each of the zones Z1-Zn. As shown in FIG. 1, a slurry outlet 140*a* is provided for zone Z1 between screen S1 and its intermediate packer 124*b*, device 140*b* for zone Z2 and device 140*n* for zone Zn. In FIG. 1, device 140*a* is shown open while devices 140*b*-140*n* are shown in the closed position so no fluid can flow from the inside 120*a* of the outer string 120 to any of the zones Z2-Zn, until opened downhole.

In yet another aspect, the outer string 120 may further include an inverted seal below and another above each inflow control device for performing a treatment operation. In FIG. 1, inverted seals 144*a* and 144*b* are shown associated with slurry outlet 140*a*, inverted seals 146*a* and 146*b* with the slurry outlet 140*b* and inverted seals 148*a* and 148*b* with slurry outlet 140*n*. In one aspect, the inverted seals 144*a*, 144*b*, 146*a*, 146*b*, 148*a* and 148*b* may be configured so that they can be pushed inside 120 of the outer string 120 or removed from the inside of the outer string 120 after completion of the treatment operations or during the deployment of a production string (not shown) for the production of hydrocarbons from wellbore 101. Pushing inverted seals inside 120*a* the outer string 120 or removing such seals from the inside 120*a* of the outer string 120 provides increased inside diameter of the outer string 120 for the installation of a production string for the production of hydrocarbons from zones Z1-Zn compared to an outer string having seals extending inside 120*a* the outer string 120. Seals 144*a*, 144*b*, 146*a*, 146*b*, 148*a* and 148*b* may, however, be placed on the outside of the inner string instead on the inside of the outer string. In one non-limiting embodiment, the outer string 120 also includes a zone indicating profile or locating profile 190 (profile 190*a* for zone Z1, profile 190*b* for zone Z2 and profile 190*n* for zone Zn) for each zone and a corresponding set down profile 192 (192*a* for zone Z1, 192*b* for zone Z2 and 192*n* for zone Zn).

Still referring to FIG. 1, the inner string 160 (also referred to herein as the service string) may be a metallic tubular member 161 that in one embodiment includes an opening shifting tool 162 and a closing shifting tool 164 along the lower end 161*a* of the inner string 160. The inner string 160 further may include a reversing valve 166 that enables the removal of treatment fluid from the wellbore after treating each zone, and an up-strain locating tool 168 for locating a location uphole of the set down locations Such as locations 194 for zone Z1, 194*b* for zone and 194*n* for Zone Zn) when the inner string is pulled uphole, and a set down tool or set down locating tool or set 170. In one aspect, the set down tool 170 may be configured to locate each zone and then set down of the inner string at each such location for performing a treatment operation. The inner string 160 includes a plug 172 above the set down locating tool 170, which prevents fluid communication between the space 172*a* above the plug 172 and the space 172*b* below the plug 172. The inner string 160 further includes a crossover tool 174 (also referred to herein as the "frac port") for providing a fluid path 175 between the inner string 160 and the outer string 120. In one aspect, the frac port 174 also includes flow passages 176 therethrough, which passages may be gun-drilled through the frac port 174 to provide fluid communication between space 172*a* and 172*b*. In one embodiment, the passages 176 are sufficiently narrow so that that there is relatively small amount of fluid flow through such passages. The passages 176, however, are sufficient to provide fluid flow and thus pressure communication between spaces 172*a* and 172*b*.

To perform a treatment operation in a particular zone, for example zone Z1, lower packer 124*a* and upper packer 124*m* are set or deployed. Setting the upper 124*m* and lower packer 124*a* anchors the outer string 120 inside the casing 104. The production zone Z1 is then isolated from all the other zones. To isolate zone Z1 from the remaining zones Z2-Zn, the inner string 160 is manipulated so as to cause the opening shifting tool 162 to open a monitoring valve 133 in screen S1. The inner string 160 is then manipulated (moved up and/or down) inside the outer string 120 so that the set down tool 170 locates the locating or indicating profile 190*a*. The set down tool 170 is then manipulated to cause it to set down in the set down profile 192*a*. When the set down tool 170 is set down at location 192*a*, the frac port 174 is adjacent to the slurry outlet 140*a*. The pipe 161 of the inner string 160 has a sealing section that comes in contact with the Inverted seals 144*a* and 144*b*, thereby isolating or sealing section 165 between the seals 144*a* and 144*b* that contains the slurry outlet 140*a* and the frac port 174 adjacent to slurry outlet 140*a*, while providing fluid communication between the inner string and the slurry outlet 140*a*. Sealing section 165 from the section 169 allows the lower port 127*a* of the packer setting device 125*b* to be exposed to the pressure in the section 165 while the upper port 127*b* is exposed to pressure in section 169. The packer 124*b* is then set to isolate zone Z1. Once the packer 124*b* has been set, frac sleeve 140*a* is opened, as shown in FIG. 1, to supply slurry or another fluid to zone Z1 to perform a fracturing or a treatment operation. Once zone Z1 has been treated, the treatment fluid in the wellbore is removed by closing the reversing valve 166 to provide a fluid path from the surface in the space (or annulus) between the outer string 120 and the inner string 160 so that a fluid supplied into such annulus at the surface will cause the treatment fluid to move to the surface, which process is referred to as reverse circulation. After reverse circulation, the inner string 160 may then be moved to set down device 170 at another zone for treatment operations. A non-limiting embodiment of a flow device for reverse circulation is described below in reference to FIGS. 3-4.

Figure 2:
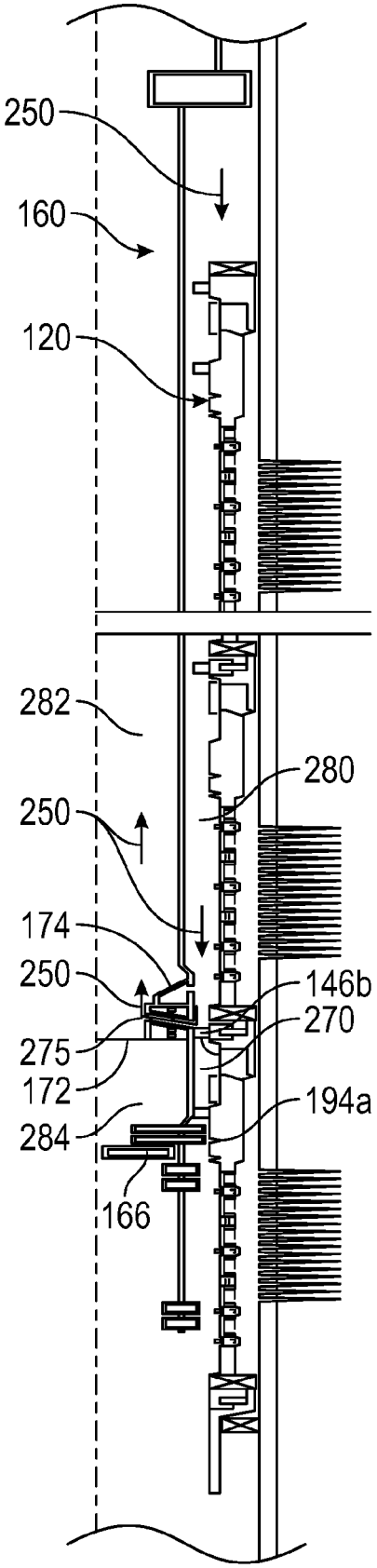
FIG. 2 shows position of the inner string for reverse circulation to remove treatment fluid from the wellbore using a flow control device made according to one non-limiting embodiment.

FIG. 2 shows the position of the inner string 160 in the outer string with the reversing valve 160 closed in order to perform a reverse circulation operation. To perform reverse circulation, the inner string is moved to cause the up-strain locating tool 168 to locate and engage with the up-strain locating profile 194*a*. In this position, the frac port seals with seal 146*a* and creates a fluid passage between annulus 280 and the inner string section 282 above the device 172. The flow device 166 is then closed, as described in detail in reference to FIG. 4, to prevent flow of the fluid from section 282 section 284 below the flow device 166. A fluid supplied into the annulus 280 will flow into section 282 via frac port opening 275 to move the fluid in section 282 to the surface, as shown by arrows 250.

Figure 3:
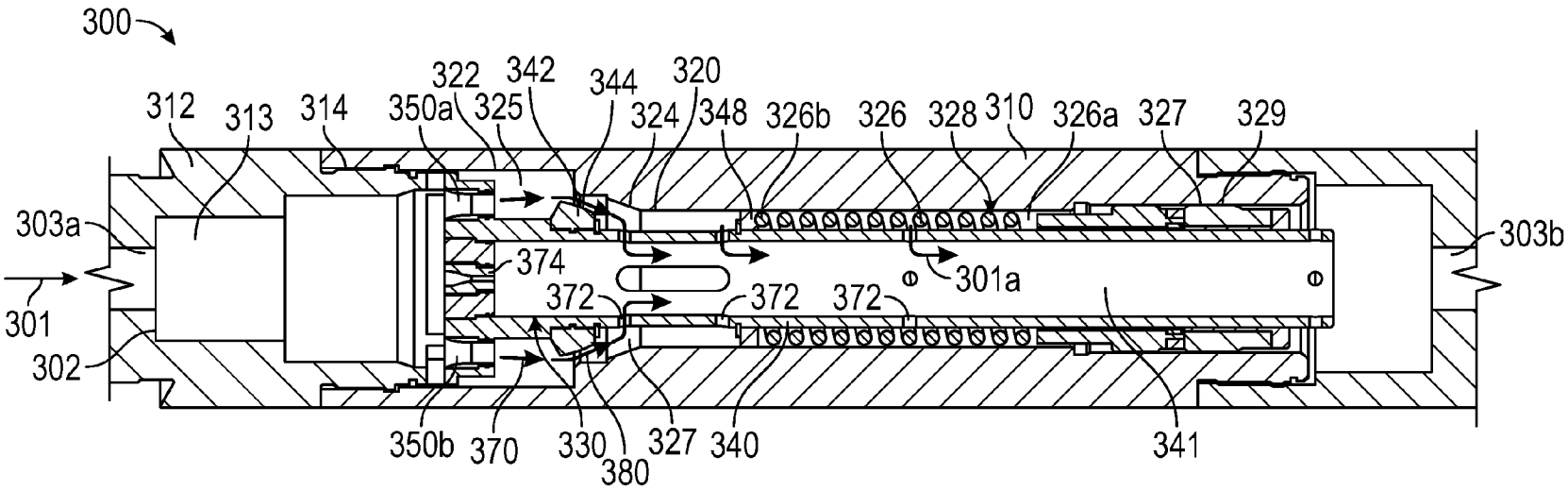
FIG. 3 shows a non-limiting embodiment of a flow control device (also referred to herein as the "valve" or "reversing valve") in an open position that may be utilized for, among other things, reverse circulation.

FIG. 3 shows a non-limiting embodiment of a flow control device 300 (also referred to herein as the "valve" or "reversing valve" for ease of explanation and not as a limitation) that may be hydraulically-activated to control flow of a fluid therethrough and which device may be utilized in wellbore operations, including, but not limited to, reverse circulation of a fluid in well treatment operations such as fracing, sand packing and gravel packing. Device 300 in FIG. 3 is shown open or in an open position so that fluid 301 in pipe 302, uphole or upstream location 303*a* of the device 300, may flow to a downhole or downstream location 303*b* of the device 300. In one aspect, the device 300 includes a valve housing 320 connected to a top sub 312, such as by a threaded connection 314. The top sub 312 has a flow through bore 313. The valve housing 320 includes flow passage or flow area 325 and contains a seal face or seal shoulder 324 and houses a biasing member, such as spring 326, proximate to an end 328 opposite of the seal shoulder 324. The lower end 326*a* of the spring 326 abuts against a spring retaining member 329 attached to the valve housing 320, such as by a threaded connection 327.

Still referring to FIG. 3, the flow control device 300 has a movable valve mechanism or unit 330 that moves inside the valve housing 320 to close the flow of a fluid 301 through the device 300 in response to the flow, and thus the pressure, of the fluid 301. The valve mechanism 330 that includes an axially-movable valve body 340 that moves axially in the top sub 312 and the valve housing 320 in response to a pressure applied thereto by the fluid 301 supplied to the tubing 302 attached to the top sub 312. In one aspect, the valve body 340 is configured to axially move inside the valve housing 320. The upper or uphole end of the valve body 340 includes one or more flow passages, such as passages 352*a* and 352*b* (also referred to herein as main passages) and a weep hole 374. The valve body 340 has a bore 341 therein (a flow passage) that receives the fluid 301 from the flow passages 352*a*, 352*b* and the weep hole 374. The passage 341 allows such received fluid to flow downhole through the device 300. The valve body 340 also may include a seal member 342 that protrudes radially outward therefrom and moves inside the flow area 325 in the valve housing 320. The seal member 342 has an outer profile or seal face 344 that matches the inside profile or seal of the shoulder 324 in the valve housing 320. The valve body 340 further includes a spring acting member 348 that protrudes radially outward into the valve housing 320 and acts on the upper end 326*b* of the spring 326. Flow through passages, such as one or more nozzles 350*a* and 350*b* allow flow of fluid 301 received by the pipe 302 to flow into the flow area 325 inside the valve housing 320. The fluid from the area 325 flows into the bore 341 of the valve body 340 via passages 372 in the valve body 340, as shown by arrows 370 and 380. A relatively small passage 374 (also referred to as the "weep hole") is provided in the movable member 340 to allow uninhibited flow of a relatively small amount of fluid 301 from the pipe 302 into the bore 341 of the valve body 340.

Still referring to FIG. 3, the valve unit 330 that includes the valve body 340, flow passages 350*a* and 350*b* and weep hole 374 are connected or are formed in such a manner that these elements or members axially moves in response the flow of the fluid 301 applied to the uphole end of the valve unit 330. When fluid 301 is supplied to the pipe 302, it acts on the uphole end of the valve unit 330, wherein the nozzles 350*a* and 350*b* and the weep hole 374 allow the fluid 301 to flow from the pipe 302 into the bore 341 of the valve body 340 via the flow area 325 and passages 372 as shown by arrows 380. The spring 326 acting on the valve body 340 prevents the valve body 340 and, thus, the valve unit 330, from moving downward. When the flow rate of the fluid 301 is increased, the pressure applied by the fluid 301 on the valve unit 330, and thus the valve body 340, increases. When the flow rate exceeds a threshold value (also referred to as the selected rate or predetermined rate), the pressure applied on the valve unit 330 and thus the valve body 340, creates sufficient pressure drop or differential across the nozzles 350*a* and 350*b* to cause the member valve unit 330 and thus the valve body 340 and the seal face 342 to move downward to cause the seal surface 344 to abut against the seal surface 327 of the shoulder 324. This closes the fluid passage from the flow area 325 to the passages 372 in the valve body 340, thereby preventing flow of the fluid 301 from the tubing 302 through the flow passages 350*a* and 350*b*. A relatively small amount of the fluid 301, however, continues to flow from the tubing 302 into the bore 341 via the weep hole 374. The weep hole equalizes the pressure across the flow passages 352*a* and 352*b*, which prevents creation of a vacuum condition (also referred to as swabbing) inside the valve body 340 as described in reference to FIG. 4. As long as the pressure applied by the fluid 301 remains above the threshold value, the valve 700 remains closed.

Figure 4:
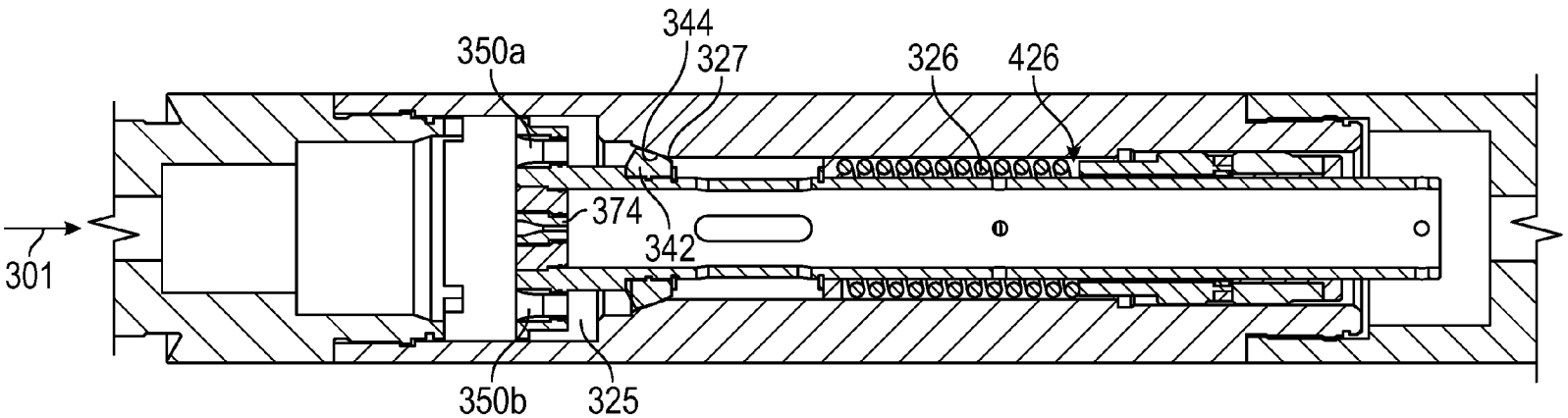
FIG. 4 shows the device of FIG. 3 in a closed position to enable reverse circulation.

FIG. 4 shows the device 300 in the closed position. As described above in reference to FIG. 3, when the pressure of the fluid 301 is above a threshold or predetermined value, the valve unit 330 that includes the valve body 340, flow passages 350*a*, 350*b* and the weep hole 374, moves downward until the seal surface 344 of valve closing member 342 abuts against the shoulder 324, as shown in FIG. 4. The spring 326 is correspondingly moved by the member 348 downward, which compresses the spring, as shown by the compressed state 426. As long as the pressure applied by the fluid 301 remains above the threshold value, the valve closing member 342 will remain in sealing contact with the shoulder 324, causing the device to remain closed and such that no, or substantially no, fluid will pass via the flow through passages 350*a* and 350*b*. A relatively predetermined small amount of fluid continues to flow through the weep hole 374, which prevents creation of a vacuum condition in the valve body 340 (i.e. prevents swabbing). When the flow of the fluid 301 is reduced below a certain rate, the pressure differential across the uphole side and the valve body decreases to a value that is insufficient to hold the spring in its compressed state, at which point the valve body 340 moves uphole, which moves the valve closing member 342 uphole, thereby opening the passage 325, which allows the fluid 301 to flow from the pipe 302 to the valve body 340 as described in reference to FIG. 3 above. The sizes of the flow passages 350*a* and 350*b* are configured to allow sufficient flow of the fluid 301 therethrough when the device 300 is open to avoid creating pressure differential across the uphole side 303*a* and the downhole side 303*b* above a desired or selected value until the flow rate of the fluid 301 exceeds a threshold value. The size of the weep hole 374 is configured so that the flow of the fluid 301 therethrough does not reduce the pressure differential below the desired value when the device is closed as shown in FIG. 3. The flow of the fluid 301, however, is sufficient such that when the valve opens suddenly or rapidly, it will not cause a vacuum condition to occur in the valve body 340. Also, when the flow device 300 moves in the wellbore with the valve closed (while reversing), the weep hole 374 allows transferring fluid 301 across the valve, which prevents the service tool from swabbing. During well operations, the hydrostatic pressure in the wellbore (due to the weight of the fluid column in the wellbore) is greater that the formation pressure. If swabbing occurs, in some cases the pressure in the wellbore below the device 300 may drop below the formation pressure, causing fluid from the formation to flow into the wellbore. In one aspect, the weep hole 374 may be configured so that pulling the inner string upward will not allow the pressure in the wellbore to drop below the formation pressure.

Flow control device 300, thus, in one aspect, may be a flow device that includes a weeping flow passage (a weeping check valve) that closes when a certain or selected amount of pressure differential is created across the device. The flow control device 300 closes when fluid flow applied thereto is above a certain rate, which causes a pressure drop across the flow control device 300 exceeding a predetermined or selected pressure value. The flow control device 300, however, remains open when the service string is manipulated to perform one or more operations in a wellbore, such as running the service string into the wellbore, setting the service string to frac a particular zone, lifting the service string, etc. The weep hole or flow passage 374 prevents swabbing, i.e., prevents a vacuum-like condition below the valve in the service string, which may also improve reliability of the flow control device for multi-zone applications, wherein the flow control device may be opened and closed several times for treating each zone. The opening and closing of the flow control device 300 also does not require any interaction with the outer string 120, i.e., tool manipulation is not required to open or close the flow device 300. Moving the device 300 at a certain speed in the wellbore 101 (FIG. 1) filled with a drilling fluid or supplying a fluid at a certain rate to the device 300 or a combination thereof, will open or close the device 300. Also, if the inner string is moved upward at a high rate, swabbing may cause the inner string 160 to hydraulically lock in the outer string 120 and may prevent further pulling of the inner string. Weep hole 374 prevents such an occurrence. A flow control device made according to an embodiment of this disclosure is also useful in open hole applications. In open holes, no casing exists inside the wellbore, but wellbores may be lined with a membrane to prevent fluid loss from the wellbore to the formation. Swabbing may pull the membrane inside the wellbore, exposing a greater area for fluid loss from the wellbore into the formation. In other situations swabbing may cause a section of the wellbore, particularly a soft formation section, to collapse and close the wellbore. Thus, in an aspect, device 300 may prevent collapsing of an open hole section and fluid loss.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a housing having a longitudinal axis for flow of fluid along the longitudinal axis; and a valve body having a first end and a second end, the valve body being movable in the housing along the longitudinal axis, the valve body including a main passage oriented along the longitudinal axis that allows a fluid supplied to the first end of the valve body to flow through the main passage into a flow area in the housing and a weep hole that allows the fluid supplied to the first end of the valve body to flow through the weep hole to enter the valve body, the valve body attaining a first position when a pressure of the fluid supplied to the first end is below a threshold rate, the first position allowing fluid to pass into the valve body via the main passage and the flow area and the valve body attaining a second position when the pressure of the fluid supplied to the first end is above the threshold rate, the second position preventing the flow of the fluid through the main passage while allowing the fluid to flow through the weep hole.

2. The apparatus of claim 1, wherein the housing includes a seal member and the valve body includes a closing member, wherein the valve body moves from the first position to the second position when the fluid supplied is above the threshold rate.

3. The apparatus of claim 2, wherein the valve body has a bore therein that receives the fluid from the flow passage in the housing and the weep hole.

4. A flow control device, comprising;

a housing having a longitudinal axis for flow of fluid along the longitudinal axis;

a valve body movable in the housing along the longitudinal axis, the valve body including a main flow passage and a weep hole at an upper end with the main flow passage oriented along the longitudinal axis, wherein when a fluid acts on an upper end of the valve body above a selected rate, the valve body moves along the longitudinal axis from an open position to a closed position to prevent flow of the fluid through the main flow passage while allowing the fluid to pass through the weep hole to prevent swabbing when the valve body moves in the housing or a fluid is supplied to the valve body above a selected rate or a combination thereof.

5. The flow control device of claim 4, wherein a biasing member acting on the valve body causes the valve body to remain in the open position when a rate of the fluid acting on the valve body is below the selected rate.

6. The flow control device of claim 4, wherein:

the housing includes a flow area configured to receive the fluid from the main flow passage in the valve body; and the valve body includes a closing device that closes the flow of the fluid through the flow area in the housing when the valve body moves from the open position to the closed position.

7. The flow control device of claim 6, wherein the valve body includes at least one flow passage to receive the fluid from the flow area in the housing.

8. The flow control device of claim 4, wherein the valve body has a first end for receiving the fluid supplied to the valve body and a second end for receiving the fluid passing through the main flow passage and the weep hole.

9. The flow control device of claim 4, wherein the housing includes a seal surface in the flow passage in the housing and the valve body includes a closing member that abuts against the seal surface to close the flow of the fluid through the main flow passage when the valve body moves from the open position to the closed position.

10. The flow control device of claim 4, wherein the housing is connected to a top sub and a portion of the valve body moves within a through-opening in the top sub.

11. The flow control device of claim 10, wherein the top sub is connected to a service string configured to perform a well operation.

12. A flow control device comprising:

a housing having a longitudinal axis for flow of fluid along the longitudinal axis;

a valve body movable in the housing along the longitudinal axis, the valve body having a main flow passage and a weep hole at a first end of the valve body near an upstream end of the housing, with the main flow passage oriented along the longitudinal axis, wherein the main flow passage closes when a fluid is supplied to the first end of the valve body that exceeds a selected rate and opens when the fluid supplied to the first end of the valve body is below the selected rate and wherein the weep hole continues to allow the fluid therethrough.

13. The flow control device of claim 12, wherein the weep hole enables the flow control device to move in a wellbore with the flow control device closed without creating a vacuum condition in the wellbore.

14. An apparatus for use in a wellbore, comprising:

a service assembly including an inner string inside an outer string, the inner string including a valve configured to close flow of fluid through the inner string, wherein the valve includes:

a housing having a longitudinal axis for flow of fluid along the longitudinal axis, and a valve body movable in the housing along the longitudinal axis, the valve body including a main flow passage and a weep hole at a first end of the valve body near an upstream end of the housing, with the main flow passage oriented along the longitudinal axis, wherein the main flow passage closes when a fluid supplied to the first end of the valve body exceeds a selected rate and opens when the fluid supplied to the first end of the valve body is below the selected rate and wherein the weep hole allows the fluid to pass through the valve.

15. The apparatus of claim 14, wherein the inner string includes a crossover fluid passage that allows fluid communication between an annulus located between the inner string and the outer string, wherein a fluid supplied to the annulus above a selected rate acts on the valve to prevent flow of the fluid through the main passage and allow the fluid supplied to the annulus to circulate through the inner string.

16. The apparatus of claim 15, wherein the weep hole prevents creation of a vacuum condition in the inner string when the valve moves in a wellbore with the valve closed.

* * * * *